US007216492B2

(12) United States Patent
Sellers

(10) Patent No.: US 7,216,492 B2
(45) Date of Patent: May 15, 2007

(54) PORTABLE REFRIGERATION UNIT

(76) Inventor: Gerald Sellers, 20516 NE. 20th La., Lawtey, FL (US) 32058

( * ) Notice: Subject to any disclaimer, the term of this patent is extended or adjusted under 35 U.S.C. 154(b) by 215 days.

(21) Appl. No.: 10/973,740

(22) Filed: Oct. 26, 2004

(65) Prior Publication Data

US 2006/0086124 A1 Apr. 27, 2006

(51) Int. Cl.
*F25B 45/00* (2006.01)

(52) U.S. Cl. ..... 62/77; 62/298

(58) Field of Classification Search ..... 62/77, 62/262, 297, 298, 448, 454, 455; 285/33, 285/80; 251/146, 148, 152
See application file for complete search history.

(56) References Cited

U.S. PATENT DOCUMENTS 2,492,601 A * 12/1949 Steel ..... 62/443
2,708,833 A * 5/1955 Nigro ..... 62/262
2,708,835 A * 5/1955 Nigro ..... 62/262
2,984,086 A * 5/1961 Wertheimer ..... 62/262
3,611,743 A * 10/1971 Manganaro ..... 62/263
3,802,216 A * 4/1974 Brandimarte ..... 62/262
5,368,337 A * 11/1994 Torres ..... 285/114
5,448,896 A * 9/1995 Rushing ..... 62/255
5,737,938 A * 4/1998 Liu ..... 62/425
6,446,455 B1 * 9/2002 Sohn et al. ..... 62/298

FOREIGN PATENT DOCUMENTS

GB 2112511 A * 7/1983
WO WO 93/01459 * 1/1993

* cited by examiner

*Primary Examiner*—Mohammad M. Ali
(74) *Attorney, Agent, or Firm*—Thomas C. Saitta

(57) ABSTRACT

A portable refrigeration unit for cooling a refrigerated space, the unit comprising an evaporator unit that is separable from a condensing unit, the evaporator unit and condenser unit being connected by extended lengths of flexible hosing, such that the evaporator unit can be positioned within the space and the condenser unit positioned external to the space during cooling operations.

9 Claims, 3 Drawing Sheets

PORTABLE REFRIGERATION UNIT

BACKGROUND OF THE INVENTION

The present invention generally relates to the field of refrigeration and more specifically to devices, apparatuses and systems used to refrigerate enclosed structural spaces of the type often referred to as walk-in freezers or walk-in coolers. More particularly, the invention relates to such devices that are electrically powered and comprise compressor, condenser and evaporator components, wherein the compressor circulates a refrigerant such as Freon gas, delivering the refrigerant in liquid state at high pressure to the condenser where the temperature is reduced, typically by passing air over the condenser. The refrigerant is then drawn into the evaporator, where it evaporates or expands into a gas state and absorbs heat from the air to be cooled, before being drawn back into the compressor for condensing and recirculation.

Most refrigeration systems do not provide a backup mechanism or redundant means for cooling a space that can be utilized when the primary system fails. The cost of such backup systems is typically too prohibitive to provide such a system for each cooler or room. Where redundant systems exist, they are integral components of the cooler or room and are not portable in any manner. Furthermore, such backup systems rely on the same high power circuits as the primary system and are thus useless in situations where the problem is a failure of the power supply rather than a mechanical failure of the primary system.

In many circumstances failure of the refrigeration system for an extended length of time results in the loss of valuable commodities, such as for example food that must be destroyed due to defrosting or warming. Likewise, there are circumstances where hazardous materials, irreplaceable items or other valuable temperature-sensitive items must be maintained at reduced temperature.

Thus, there exists a need for a redundant or secondary refrigeration system that can be utilized to maintain a refrigerated space below a desired temperature when the primary refrigeration system fails or loses power. Ideally, the secondary system is portable and can be utilized with or without retrofitting the refrigerated space. Furthermore, it is desirable that the secondary system operates from standard 115 volt power sources, whether in the form of standard outlets located within or near to the refrigerated space or a gas powered generator.

Additionally, it is often desirable to temporarily cool a room or space that has no primary refrigeration means. Thus, there exists a need for a portable refrigeration system that can be utilized to create a refrigerated space.

It is an object of this invention to provide a modular portable refrigeration unit that addresses the expressed problems, needs and desires and well as possible additional problems, needs and desires that will become obvious after review of the following disclosure. It is a further object of this invention to provide such a refrigeration unit wherein the evaporator means of the refrigeration unit can be physically distanced from the condenser means comprising the compressor and condenser while remaining in fluid communication through lengths of flexible hoses, such that the evaporator means can be positioned within the refrigerated space to be cooled, while the condenser means remains external to the refrigerated space. It is a further object to provide such a refrigeration unit wherein the evaporator means can be temporarily disconnected from the condenser means during relocation into the refrigerated space without loss of refrigerant, then easily reconnected to perform the cooling operation.

SUMMARY OF THE INVENTION

The invention is in general a refrigeration system or unit for cooling or maintaining a reduced temperature within a structural room or cooler, the refrigeration system comprising evaporator means, condenser means and fluid conduit means, with the condenser means comprising a compressor and a condenser. A refrigerant fluid capable of existing in both a liquid and gas state as required, such as for example Freon, is utilized to produce the cooling effect. The components of this refrigeration system function in the known manner for reducing the temperature of air blown through or across the evaporator means, wherein the refrigerant is compressed by the compressor, passed into the condenser to reduce the latent heat, delivered to the evaporator to expand and evaporate to absorb heat from the air within the refrigerated space, and returned to the compressor. The refrigeration unit is electrically powered, most preferably operational from standard 115 volt power sources within or adjacent the refrigerated space or from a gas powered generator.

The fluid conduit means connecting the condenser means to the evaporator means are extended lengths of flexible hoses, such as for example from about 5 to 25 feet in length, such that the evaporator means may be relocated and distanced from the condenser means without inhibiting operation of said refrigeration unit. This allows the refrigeration unit to have a non-operational configuration occupying a relatively small area during storage and transport, and an operational configuration of significantly greater area when the cooling operation is underway, allowing the evaporator means to be positioned within the refrigerated space while the compressor means remains external to the refrigerated space. The fluid conduit means remains connected during the evaporator means relocation operation, or the refrigeration unit is provided with check valve connector fittings such that the evaporator means may be disconnected from the condenser means without loss of refrigerant, repositioned within the refrigerated space and reconnected to the condenser means, either directly or through fittings provided through the walls of the refrigerated space.

In the event the primary refrigeration system of the refrigerated space fails mechanically, or if the electrical power source fails, or if a chosen non-refrigerated space needs to be temporarily converted into a refrigerated space, the portable refrigeration unit is brought to the space, the portable refrigeration unit most preferably being mounted on a wheeled support frame or cart. The evaporator means is removed from the cart and placed within the refrigerated space, with the flexible fluid conduit means extending through the access door into the refrigerated space, disconnected and passed through a smaller access port if present, or fitted to permanently installed pass-through conduits in the wall of the refrigerated space if provided. The cart and compressor means remain external to the refrigerated space. The portable refrigeration system is then powered by connection to adjacent electrical outlets or, if power has been lost, to a gas powered generator. The refrigeration operation then commences in known manner, such that the temperature of the refrigerated space is maintained as required.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

With reference to the drawings, the invention will now be described in detail with regard for the best mode and the preferred embodiment. In a broad sense, the invention is a portable refrigeration unit or system, operating either as a primary or a secondary refrigeration unit for cooling or maintaining a reduced temperature within a structural room or cooler, the refrigeration system comprising evaporator means, condenser means and fluid conduit means, with the condenser means comprising a compressor and a condenser. A refrigerant fluid capable of existing in a liquid and gas state as required, such as for example Freon, is utilized to produce the cooling effect. The components of this refrigeration system function operationally in the known manner to reduce the temperature of air blown through or across the evaporator means, wherein the refrigerant is compressed by the compressor, passed into the condenser to reduce the latent heat, delivered to the evaporator to expand and evaporate to absorb heat from the air within the refrigerated space, and returned to the compressor. The refrigeration unit is electrically powered, most preferably operational from standard 115 volt power sources within or adjacent the refrigerated space or from a gas powered generator.

Figure 1:
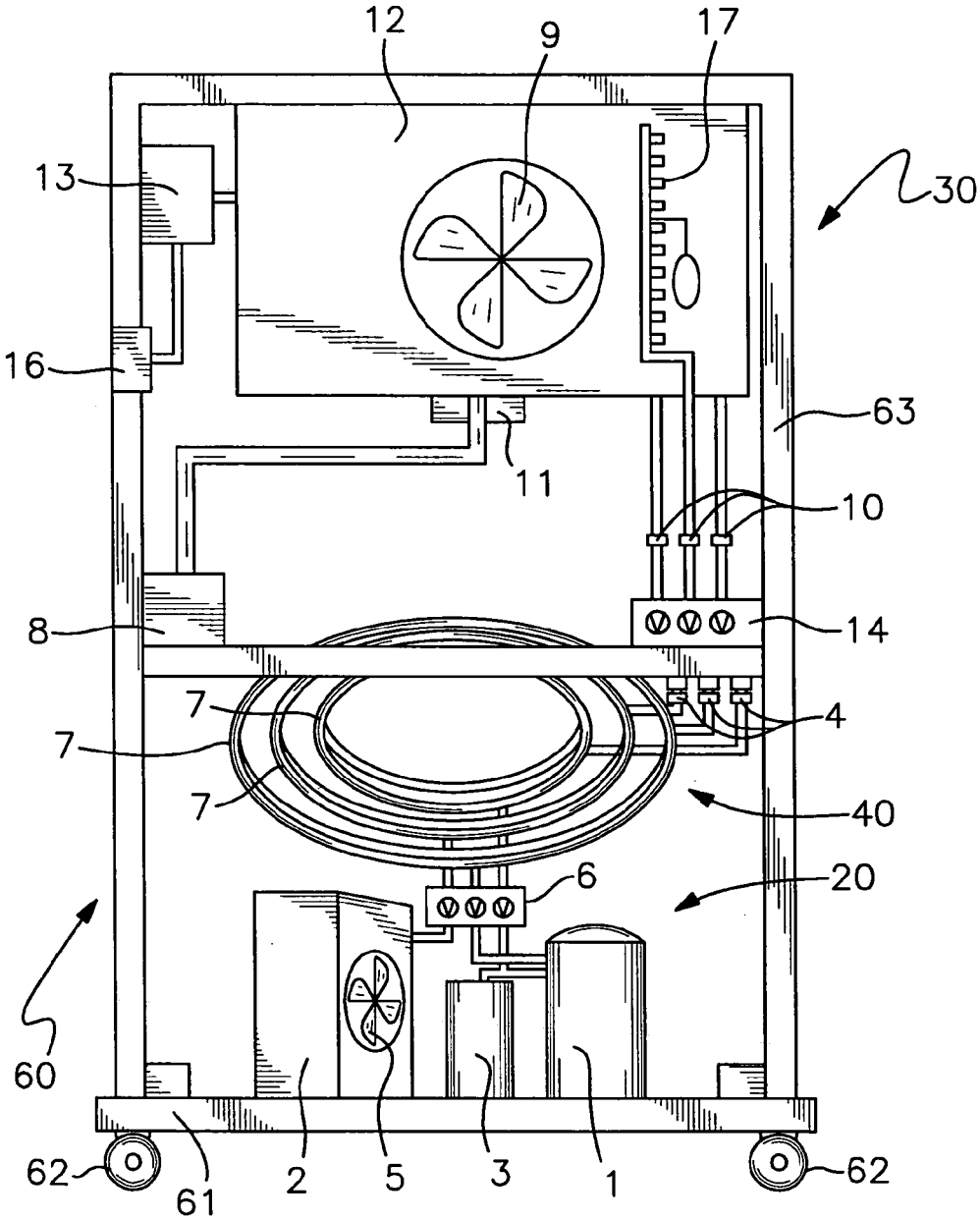
FIG. 1 illustrates the refrigeration unit in the non-operational configuration.

As shown in FIG. 1, the portable refrigeration unit comprises condenser means 20 and evaporator means 30, joined in fluid communication by fluid conduit means 40 allowing a refrigerant, such as for example Freon, to circulate through the refrigeration unit such that heat is removed from air within a refrigerated space 50 by the evaporator means 30. The condenser means 20 comprises a compressor 1 to circulate the refrigerant, a condenser 2 to cool the refrigerant, an electrically powered fan 5 to blow air across the condenser to remove heat from the compressed liquid refrigerant, and a receiver 3 to store the cooled refrigerant. Fluid conduit means 40 comprise extended lengths of flexible refrigerant hose 7 that provide fluid communication between the condenser means 20 and the evaporator means 30, the length of hoses 7 being significantly greater than the distance between the condenser means 20 and evaporator means 30 in the non-operational made. Preferably, the flexible refrigerant hoses 7 are presented in communication with the operational components of the condenser means 20 through condenser isolation valves 6 that are manually operated, and are presented in communication with the evaporator means 30 through hose connector fittings 4, such that the flexible refrigerant hoses 7 can be disconnected from the evaporator means 30 without incurring loss of refrigerant charge.

The evaporator means 30 comprises an evaporator 12 having an electrically powered fan 9 to blow air across the evaporator 12 such that heat is absorbed from the air by the expanding refrigerant within the evaporator 12, expansion valve/evaporator coil 17, refrigerant charging ports 10, controller 13 to control the fan and solenoids, a condensate pump 8, a drain/heater 11, and evaporator isolation valves 14 that are manually operated and communicate with the hose connector fittings 4. An electrical receptacle 16 is provided for connection with an electrical extension cord.

Figure 2:
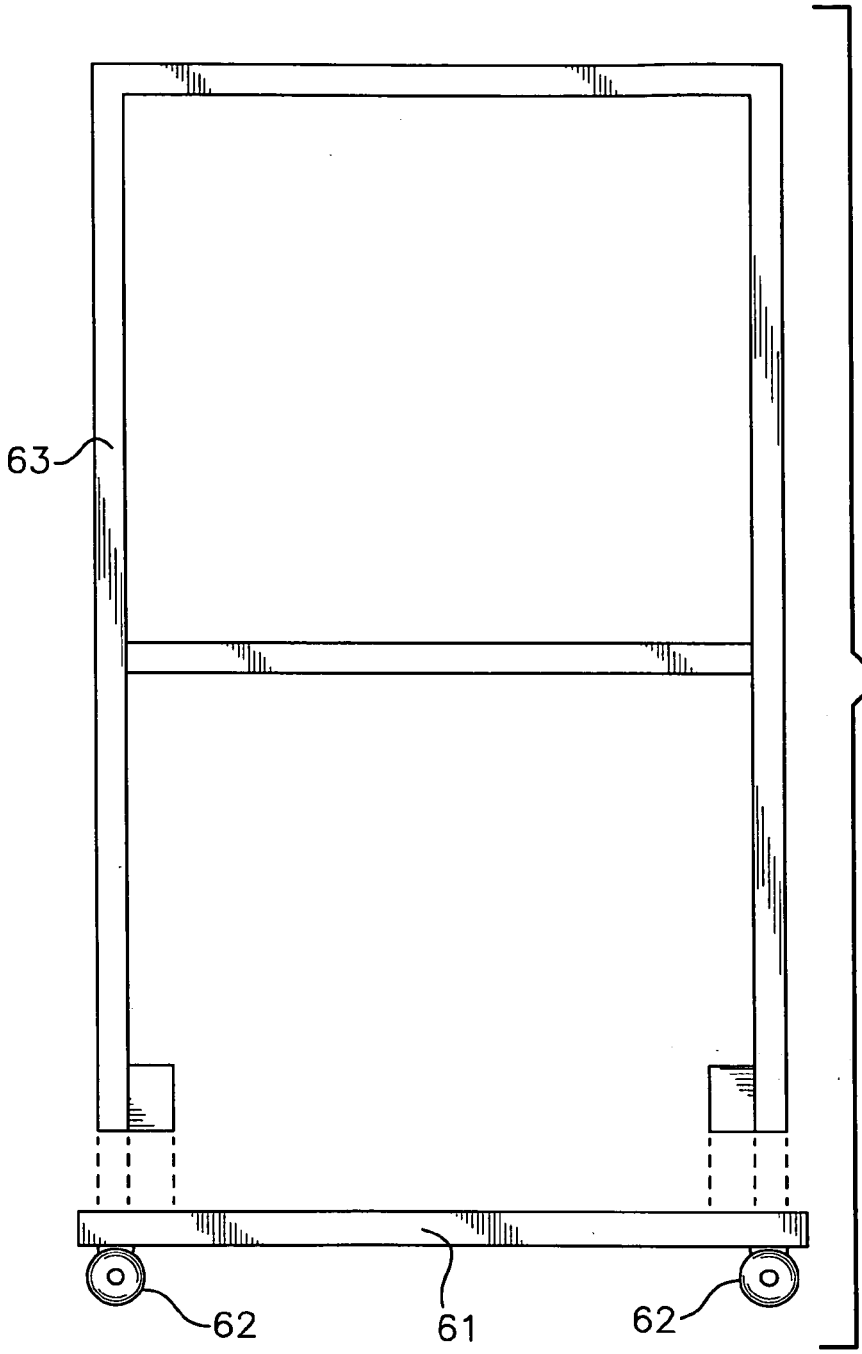
FIG. 2 independently depicts the support frame of the refrigeration unit, with the upper frame shown as separated from the base.
Figure 3:
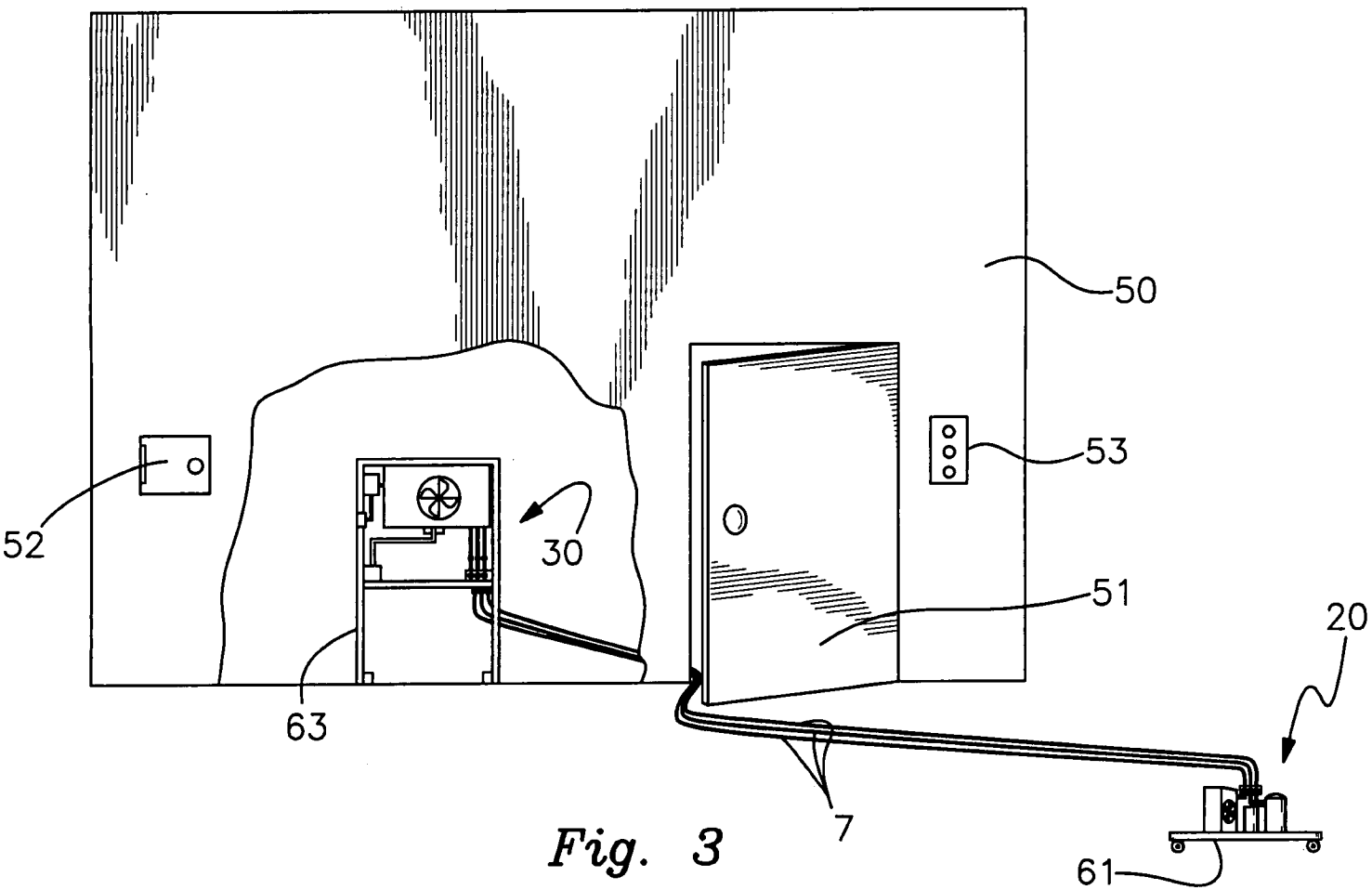
FIG. 3 illustrates the refrigeration unit in the operational configuration with the evaporator means positioned within a refrigerated space.

Most preferably, the condenser means 20 and evaporator means 30 are mounted on or supported by a wheeled support cart 60, shown in an isolated view in FIG. 2, comprising a base member 61 with wheels 62, and an upright support frame 63 that is detachable from the base member 61. The condenser means 20 is preferably disposed on the base member 61 while the evaporator means 30 is disposed above the condenser means 20, such that the evaporator means 30 can be distanced from the condenser means 20 by disconnecting the support frame 63 from the base member 61 and relocating the evaporator means 30 and the support frame 40 within the refrigerated space 50, as shown in FIG. 3.

In the event the primary refrigeration system of a refrigerated space 50, such as a walk-in freezer or cooler, fails or becomes non-functional for a period of time, whether due to mechanical failure of loss of power, the portable refrigeration unit in the non-operational configuration of relatively small area is wheeled on the support cart 60 to the access door 51 of the refrigerated space 50. The support frame 63 is disconnected from the base member 61, which remains outside of the refrigerated space 50, and the support frame 63 and evaporator means 30 supported thereon are positioned within the refrigerated space 50 in the operational configuration. During this separation and relocation, the fluid conduit means 40 may be disconnected if required or for ease of transport, such that the evaporator means 30 is temporarily in fluid non-communication with the condenser means 20. The refrigerant hoses 7 are extended through the access door 51, which will be closed as much as possible. Curtains, dams or other air blocking members may be disposed about the access door 51 if it cannot be closed completely due to the presence of the hoses 7. Alternatively, the refrigerant hoses 7 may be disconnected and routed through a small access port 52, or connected directly to pre-installed connector fittings 53 that pass through the wall of the refrigerated space 50, if either is present.

The evaporator means 30 is placed into a preferred location within the refrigerated space 50, the maximum distance from the condenser means 20 being determined by the length of the hoses 7. It has been found that hoses 7 up to approximately 25 feet in length may be utilized without significant reduction in cooling efficiency. The evaporator means 30 is then powered up by connecting to a power source within or adjacent the refrigerated space 50 or to an outside gas powered generator in the event power is down in the structure. The condenser means 20 external to the refrigerated space 50 is likewise provided with electrical power.

In this manner, air within the refrigerated space 50 is now blown across the evaporator 12 to be cooled. Thermostatic controls may be provided to control the amount of cooling. The hot refrigerant fluid, now in a gas state, is then drawn through the fluid conduit means 40 to the compressor 1 and condenser 2, where it is compressed and cooled by air blown across the condenser 2, this heated air not affecting the refrigerant space 50 since the condenser means 20 is located external to the refrigerated space 50. If necessary due to cramped conditions, the base member 61 and condenser means 20 can distanced from the refrigerated space 50 up to the distance limited by the length of the refrigerant hoses 7 in order to provide better exhaust ventilation for the heated air. The cooled refrigerant is then delivered back to the evaporator means 30 and the cycle continues.

In similar manner, the portable refrigeration unit can be used to cool a structural space having no primary refrigeration means on an as needed basis, thereby creating a refrigerated space 50.

While the invention has been described in connection with the disclosed embodiments, it is not intended to limit the scope of the invention to the particular form set forth, but on the contrary, it is intended to cover such alternatives, modifications, and equivalents as may be included within the spirit and scope of the invention as defined by the appended claims.

I claim:

1. A portable refrigeration unit for cooling a refrigerated space, said refrigeration unit having a relatively small non-operational configuration and a significantly larger operational configuration, said refrigeration unit comprising:

condenser means comprising a condenser and a compressor;

evaporator means comprising an evaporator;

fluid conduit means connecting said condenser means and said evaporator means, whereby a refrigerant is circulated between said condenser means and said evaporator means, said fluid conduit means comprising flexible hoses of a length significantly greater than the distance between said condenser means and said evaporator means when said refrigeration unit is in said non-operational configuration with said evaporator means near said condenser means;

a wheeled support cart supporting said condenser means and said evaporator means, wherein said support cart is comprised of a base member and a support frame, said wheels being connected to said base member, wherein said support frame is separable from said base member, and wherein said condenser means is supported by said base member and said evaporator means is supported by said support frame in an elevated position higher than said condenser means both when said support frame is together with said base member and when said support frame is separated from said base member;

wherein said evaporator means and said support frame are separable from said condenser means and said base member a distance limited by the length of said flexible hoses, wherein the evaporator means and said support frame may be distanced from said condenser means and said base member during operation of said refrigeration unit to define said operational configuration, such that said evaporator means may be disposed within said refrigerated space at the same time said condenser unit is disposed external to said refrigerated space.

2. The refrigeration unit of claim 1, wherein said flexible hoses are between approximately 5 and 25 feet in length.

3. The refrigeration unit of claim 1, further comprising evaporator isolation valves, wherein said fluid conduit means disconnect from said evaporator means without loss of refrigerant.

4. The refrigeration unit of claim 1, further comprising condenser isolation valves, wherein said fluid conduit means disconnect from said condenser means without loss of refrigerant.

5. The refrigeration unit of claim 3, further comprising condenser isolation valves, wherein said fluid conduit means disconnect from said condenser means without loss of refrigerant.

6. The refrigeration unit of claim 1, wherein said refrigeration unit is electrically powered.

7. The refrigeration unit of claim 6, wherein said refrigeration unit is powered at 115 volts.

8. A method of providing secondary refrigeration to a refrigerated space having an access door comprising the steps of:

providing a portable refrigeration unit comprising condenser means, evaporator means, fluid conduit means connecting said condenser means and said evaporator means for circulation of refrigerant, and a wheeled support cart comprising a base member and a support frame, wherein said support frame supports said evaporator means above said condenser means, and wherein said evaporator means and said support frame are together separable from said condenser means and said base member;

positioning said condenser means and said base member outside of said refrigerated space;

extending said fluid conduit means through said access door of said refrigerated space;

positioning said evaporator means and said support frame within said refrigerated space, said evaporator means being supported by said support frame in an elevated position within said refrigerated space;

powering said refrigeration unit so as to lower the temperature within said refrigerated space.

9. The method of claim 8, further comprising the steps of:

disconnecting said fluid conduit means from said evaporator means prior to extending said fluid conduit means through said access door of said refrigerated space;

reconnecting said fluid conduit means to said evaporator means after positioning said evaporator means within said refrigerated space.

* * * * *